US012000683B2

(12) United States Patent
Thompson

(10) Patent No.: US 12,000,683 B2
(45) Date of Patent: Jun. 4, 2024

(54) TRACKABLE AMMUNITION

(71) Applicant: Vance Thompson, Sioux Falls, SD (US)

(72) Inventor: Vance Thompson, Sioux Falls, SD (US)

( * ) Notice: Subject to any disclaimer, the term of this patent is extended or adjusted under 35 U.S.C. 154(b) by 408 days.

(21) Appl. No.: 17/293,311

(22) PCT Filed: Nov. 14, 2019

(86) PCT No.: PCT/US2019/061382
§ 371 (c)(1),
(2) Date: May 12, 2021

(87) PCT Pub. No.: WO2020/102482
PCT Pub. Date: May 22, 2020

(65) Prior Publication Data

US 2022/0011080 A1 Jan. 13, 2022

Related U.S. Application Data

(60) Provisional application No. 62/768,511, filed on Nov. 16, 2018.

(51) Int. Cl.

| | |
|---|---|
| ***F42B 12/38*** | (2006.01) |
| ***F42B 30/00*** | (2006.01) |
| *F42B 7/04* | (2006.01) |
| *F42B 30/02* | (2006.01) |
| *F42B 30/08* | (2006.01) |

(52) U.S. Cl.
CPC ..... *F42B 12/382* (2013.01); *F42B 30/006* (2013.01); *F42B 7/04* (2013.01); *F42B 30/02* (2013.01); *F42B 30/08* (2013.01)

(58) Field of Classification Search
CPC ..... F42B 12/382; F42B 30/006; F42B 7/04; F42B 30/02; F42B 30/08
USPC ..... 102/501
See application file for complete search history.

(56) References Cited

U.S. PATENT DOCUMENTS

| | | | | |
|---|---|---|---|---|
| 5,646,365 | A | 7/1997 | Collier | |
| 9,749,789 | B1 * | 8/2017 | Edmonds | H04W 4/023 |
| 10,905,941 | B2 * | 2/2021 | Hong | A63F 13/837 |
| 2010/0037794 | A1 | 2/2010 | Authement, Sr. | |
| 2013/0220160 | A1 * | 8/2013 | Burdine | F42B 12/385 124/56 |
| 2015/0033973 | A1 | 2/2015 | Harvey | |
| 2015/0038048 | A1 | 2/2015 | Rosenberg | |
| 2015/0268017 | A1 * | 9/2015 | Diemer | F42B 7/02 102/439 |

(Continued)

OTHER PUBLICATIONS

"International Application Serial No. PCT/US2019/061382, International Search Report dated Feb. 20, 2020", 2 pgs.

(Continued)

*Primary Examiner* — Samir Abdosh
(74) *Attorney, Agent, or Firm* — Schwegman Lundberg & Woessner, P.A.

(57) ABSTRACT

Disclosed are ammunition and ammunition tracking systems. The ammunition and ammunition tracking system may include a first projectile and a marker. The marker may be associated with the first projectile. The marker may contain a unique signature such that the first projectile may be identifiable from a second projectile.

15 Claims, 3 Drawing Sheets

(56) References Cited

U.S. PATENT DOCUMENTS

| | | | | |
|---|---|---|---|---|
| 2016/0131464 | A1* | 5/2016 | Rubin | F42B 12/54<br>102/501 |
| 2016/0273894 | A1 | 9/2016 | Amick | |

OTHER PUBLICATIONS

"International Application Serial No. PCT/US2019/061382, Written Opinion dated Feb. 20, 2020", 8 pgs.
"International Application Serial No. PCT/US2019/061382, International Preliminary Report on Patentability dated May 27, 2021", 10 pgs.

* cited by examiner

TRACKABLE AMMUNITION

CLAIM OF PRIORITY

This patent application is a U.S. National Stage Filing under 35 U.S.C. 371 from International Application No. PCT/US2019/061382, filed on Nov. 14, 2019, and published as WO 2020/102482 on May 22, 2020, which application claims the benefit of priority of U.S. Provisional Patent Application Ser. No. 62/768,511, entitled "TRACKABLE AMMUNITION," filed on Nov. 16, 2018, which is hereby incorporated by reference herein in its entirety.

SUMMARY

Disclosed are ammunition and ammunition tracking systems. The ammunition and ammunition tracking system may include a first projectile and a marker. The marker may be associated with the first projectile. The marker may contain a unique signature such that the first projectile may be identifiable from a second projectile.

BRIEF DESCRIPTION OF THE FIGURES

The above-mentioned and other features and advantages of this disclosure, and the manner of attaining them, will become more apparent and the disclosure itself will be better understood by reference to the following description of embodiments of the disclosure taken in conjunction with the accompanying drawings, wherein.

Corresponding reference characters indicate corresponding parts throughout the several views. The exemplifications set out herein illustrate exemplary embodiments of the disclosure, and such exemplifications are not to be construed as limiting the scope of the disclosure any manner.

DETAILED DESCRIPTION

Figure 1A:
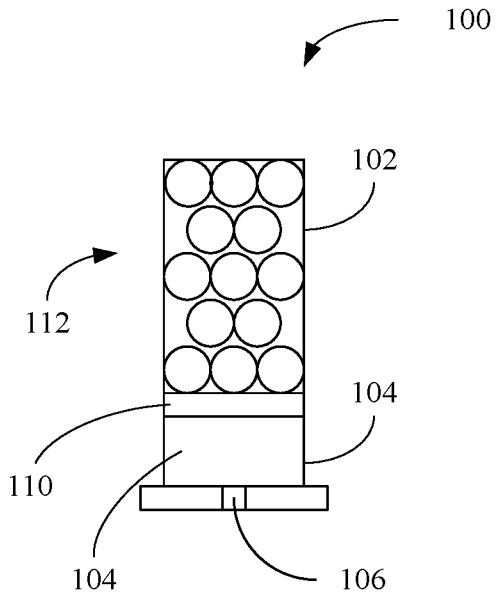
FIG. 1A shows an example schematic of ammunition consistent with embodiments disclosed herein.

The following detailed description refers to the accompanying drawings. Wherever possible, the same reference numbers are used in the drawings and the following description to refer to the same or similar elements. While embodiments and examples are described, modifications, adaptations, and other implementations are possible. For example, substitutions, additions, or modifications may be made to the elements and stages illustrated in the drawings, and the systems and methods described herein may be modified by substituting, reordering, or adding stages to the disclosed methods or elements to the disclosed systems. Accordingly, the following detailed description does not limit this disclosure. Instead, the proper scope of any invention disclosed herein is defined by the appended claims.

During a hunt, multiple hunters may be part of a hunting party. Upon encountering game, such as birds, the various members of the hunting party may fire at the game. For example, during a bird hunt, upon encountering a flock of birds each of the hunters may shoot at the flock. Each of the hunters may shoot more than one shot. In addition, because the hunters may be using shotguns, multiple pellets from a single shot may strike multiple birds. As a result, using conventional ammunition, there may not be a way to determine which hunter actually shot a bird.

As disclosed herein, ammunition may include a marker. The marker may allow the ammunition to be traced to a particular hunter. Stated another way, the marker may allow projectiles, such as shot or a bullet, to be matched to a particular hunter of a hunting party. By matching the projectiles to a particular hunter, the hunters in a hunting party may be able to determine which hunter is responsible for shooting the most game.

Because projectiles may be traced back to a particular hunter, the hunt may be more enjoyable because each hunter may be able to track his or her contributions to the hunt. In addition, the hunters may be able to place side wagers as to who is the best shot. Also, after determining who had the better hunt, good natured ribbing may ensue, thus, making the hunt more sporting and enjoyable for the hunting party.

In addition, hunting guides or law enforcement may use the ability to track game taken by the hunters. For example, after a hunt, a guide may determine which hunter is responsible for taking the most game and rank the members of the hunting party. Using the ranking, the guide may charge the different hunters a different fee. For example, the hunter that took the most game may be charged X dollars and the hunter that took the least game may be charged Y dollars with the other hunters charged an amount in between X and Y. Stated another way, the guide may set his or her pricing so as to distribute the cost of the hunt among the hunters based on the number of game each hunter takes. Also, the hunters themselves may agree to a pro rate to fee for the hunt. For example, the hunter that takes the most game may pay the least and the hunter that takes the least game may pay the most. Thus, the hunt becomes more than just a hunt; it is also a competition between the hunters with extra stakes.

In addition to hunting, the projectiles and markers disclosed herein can be used in nonlethal competitive games. For example, markers can be used in paintball, airsoft, and with simunition. For instance, markers can be encapsulated in a paintball or simunition round. Upon impacting a participant, the paintball or simunition round can rupture and the paint cause the marker to stick to the participant. In this manner, the rounds impacting participants can be counted and distinguished from other shooters even when the same color paintballs are used.

Turning now to the figures, FIG. 1A shows an example schematic of ammunition 100 consistent with embodiments disclosed herein. Ammunition 100 may be representative of a shotgun round. As shown in FIG. 1A, ammunition 100 may include a casing 102, a cap 104, a primer 106, a propellent 108, a wad 110, and one or more projectiles 112. Casing 102 and cap 104 may form a housing that contains propellant 108, wad 110 and projectiles 112. Primer 106 may pass through cap 104 into the housing formed by casing 102 and cap 104.

During use, a firing pin of a firearm, not shown, may strike primer 106, which may cause primer 106 to create a spark or other incendiary action. The spark may cause propellant 108 to explode. The explosion of propellant 108 may apply a pressure to wad 110, which in turn may force projectiles 112 from a muzzle of the firearm. While FIG. 1A shows multiple projectiles, such as shot associated with various shotgun ammunition, ammunition 100 may also include a single projectile, such as a slug associated with various shotgun ammunition. In addition, ammunition 100 may include shot and a slug. The shot and the slug may each have the same or different markers without departing from the scope of this disclosure.

Figure 1B:
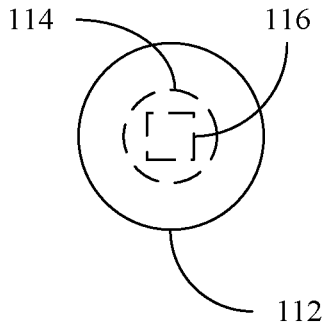
FIG. 1B shows an example projectile of the ammunition of FIG. 1A consistent with embodiments disclosed herein.

As shown in FIG. 1B, projectile 112 may define a cavity 114. Inside cavity 114 may be a marker 116. As disclosed herein, marker 116 may be a radio frequency identifier (RFID) chip or other electronic device that may emit a signal.

While FIG. 1B shows marker 116 being a separate component that is located within cavity 114, marker 116 may be associated with projectile 112 in other fashions. For example, marker 116 may be a chemical marker, such as a florescent dye or a chemical detectable by a detector as disclosed herein. For instance, marker 116 may be dye that glows red, green, blue, orange, etc. when exposed to ultraviolent or infrared light that coats or is impregnated into projectile 112.

In addition, marker 116 may include projectile 112 having a different metallurgical composition than a projectile from a second ammunition. For instance, projectiles 112 of ammunition 100 may have a composition of 50% aluminum, 25% copper, and 25% steel. A second projectile associated with a second ammunition may have a composition that is 50% aluminum, 25% steel, and 25% lead. As a result, the metallurgical composition of the respective projectiles may be the marker for each ammunition. The different metallurgical composition may allow the respective projectiles to be distinguishable from one another as each may have different magnetic properties or otherwise show up differently on a scan. For instance, if game is x-rayed, the different metallurgical compositions may show us differently on a screen of the x-ray machine.

As disclosed herein, marker 116 may be something that is present with projectiles 112 before they are fired from a firearm. As a result, marker 116 is not a striation or other ballistic indicator that is caused by firing projectiles 112 from the firearm. Stated another way, marker 116 does not require one or more striations caused by firing projectiles 112 from the firearm.

As disclosed herein, projectiles 112 may be manufactured from metals, polymers, ceramics, or any combination thereof. For example, projectiles 112 may be lead pellets, polymer pellets, paintballs, etc. For example, polymer pellets having marker 116 may be loaded into shotgun shells and used to hunt game, such as pheasants, quail, ducks, etc. The materials used manufacture projectiles 112 can be environmentally friendly or otherwise biodegradable. For example, projectiles 112 can be a biodegradable such that projectiles 112 that do not embed in game can decompose.

Figure 2A:
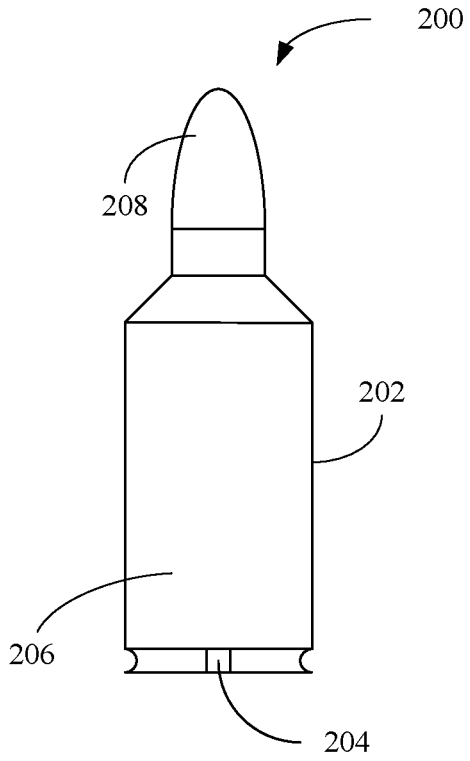
FIG. 2A shows an example schematic of ammunition consistent with embodiments disclosed herein.

FIG. 2A shows an example schematic of ammunition 200 consistent with embodiments disclosed herein. Ammunition 200 may be representative of a rifle or pistol round. As shown in FIG. 2A, ammunition 200 may include a casing 202, a primer 204, a propellent 206, and a projectile 208. Casing 202 may form a housing that contains propellant 206, and a portion of projectile 208. Primer 204 may pass through casing 202 into the housing formed by casing 202.

During use, a firing pin of a firearm, not shown, may strike primer 204, which may cause primer 204 to create a spark or other incendiary action. The spark may cause propellant 206 to explode. The explosion of propellant 206 may apply a pressure to projectile 208, which in turn may force projectile 208 from a muzzle of the firearm.

Figure 2B:
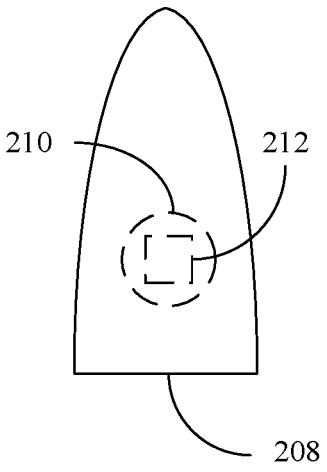
FIG. 2B shows an example projectile of the ammunition of FIG. 2A consistent with embodiments disclosed herein.

As shown in FIG. 2B, projectile 208 may define a cavity 210. Inside cavity 210 may be a marker 212. As disclosed herein, marker 212 may be a RFID chip or other electronic device that may emit a signal.

While FIG. 2B shows marker 212 being a separate component that is located within cavity 210, marker 212 may be associated with projectile 208 in other fashions. For example, marker 212 may be a chemical marker, such as a florescent dye or a chemical detectable by a detector as disclosed herein. For instance, marker 212 may be dye that glows red, green, blue, orange, etc. when exposed to ultraviolent or infrared light that coats or is impregnated into projectile 208.

In addition, marker 212 may include projectile 208 having a different metallurgical composition than a projectile from a second ammunition. For instance, projectiles 208 of ammunition 200 may have a composition of 75% lead, 25% copper, and 25% steel. As second projectile associated with a second ammunition may have a composition that is 50% aluminum, 25% steel, and 25% lead. As a result, the metallurgical composition of the respective projectiles may be the marker for each ammunition. The different metallurgical composition may allow the respective projectiles to be distinguishable from one another as each may have different magnetic properties or otherwise show up differently on a scan. For instance, if game is x-rayed, the different metallurgical compositions may show us differently on a screen of the x-ray machine.

As disclosed herein, marker 212 may be something that is present with projectiles 208 before it is fired from a firearm. As a result, marker 208 is not a striation or other ballistic indicator that is caused by firing projectile 208 from the firearm. Stated another way, marker 212 does not require one or more striations caused by firing projectiles 208 from the firearm.

As disclosed herein, projectile 208 may be manufactured from metals, polymers, ceramics, or any combination thereof. For example, projectile 208 may be lead bullet, polymer bullet, paintballs, etc. For example, a polymer bullet having marker 212 may be loaded into rifle or handgun casing and used to hunt game, such as squirrels, deer, hogs, bears, elk, etc. The materials used manufacture projectile 208 can be environmentally friendly or otherwise biodegradable. For example, projectile 208 can be a biodegradable such that projectile 208 that does not embed in game can decompose.

As disclosed herein, projectiles, such as projectiles 112 and projectile 208, may include markers, such as marker 116 and marker 212, respectively. The markers may have a unique signature such that the projectiles are identifiable from other projectiles. Stated another way, the unique signatures may allow the various projectiles to be distinguishable from one another.

When the markers are RFID chips, each of the RFID chips associate with a projectile may emit a unique signature so that the projectiles may be distinguishable from one another. For example, each shot from a first shotgun shell may have a first RFID chip embedded within it and each of the first RFID chips may have the first signature. Each shot from a second shotgun shell may have a second RFID chip embedded within it and each of the second RFID chips may have a second signature. The two signatures may be different so that shot from the first shotgun shell may be identifiable from shot from the second shotgun sell due to the differing signatures. As an example, the first RFID chips may transmit a code, such as a first alphanumeric code, and the second RFID chips may transmit a second code, such as a second alphanumeric code. The first and second alphanumeric codes may be different so that when an RFID reader reads the codes, a determination can be made as to which shot is embedded within a target, such as game. The signatures do not have to be alphanumeric codes. The signatures may include the same code transmitted on different frequencies.

As disclosed herein, the markers may include a chemical marker and the signature may be a color of light emitted from the projectiles. For example, the projectiles may be impregnated or coated with a chemical that glows red, green, orange, blue, etc. when exposed to ultraviolent or infrared light. As a result, an ultraviolent or infrared light may be used to illuminate the projectiles. Either a user or a scanner capable of differentiating the emitted colors may be used to distinguish the projectiles from one another.

The markers may also include a metallurgical composition of the projectiles. For example, as disclosed herein, percentages of the metals used to form the projectiles may vary from projectile to projectile. As a result, the projectiles may show differently on a display when a target is x-rayed. Thus, the signature may be the color shown on the display.

In addition, the different metallurgical compositions may cause different readings or distortions within a magnetic field. For example, the target may be subjected to a magnetic field and the differing metallurgical compositions may cause a change in either the H or B fields. In addition, the magnetization, M, may vary based on the metallurgical composition. An EMF meter or a Gauss meter may be used to measure the magnetic field or disturbance in the magnetic field (i.e., a signature).

Manufacturing of the projectiles, such as projectiles 112 and projectile 208, disclosed herein may be accomplished in a variety of manners. For example, the projectiles may be manufactured using conventional techniques and then a hole may be drilled, such as by laser drilling, into the projectiles. A marker, such as an RFID tag may be placed in the hole and an epoxy or other fill material may be used to close the hole and secure the marker within the projectile. The epoxy or other fill material may be machined, ground, or otherwise polished at the exterior of the projectile so as to create a smooth surface in line with the exterior of the projectile thereby minimizing disturbance to the air passing around the projectile or otherwise altering the ballistic coefficient of the projectile once it is fired.

In addition, the marker may be attached directly to an exterior of the projectile. For example, an epoxy may be used to secure an RFID tag to an exterior of the projectile and the projectile may be coated with the epoxy to give the projectile an aerodynamic shape or otherwise minimize degradation of the projectile's ballistic performance.

Either before or after the markers are installed, they may be programmed with unique codes if the markers are electronic and/or programmable. For example, RFID tags may be installed in or on projectiles and then each tag may be coded with a unique ID number. The RFID tags may also already have the unique ID number coded prior to installation. After installation the projectiles can be scanned to test that the marker is working correctly and as a way to inventory the projectiles during production.

In addition, to attaching markers to or implanting them in projectiles, markers may also be attached to casings, such as casing 102 or casing 202. The marker associated with the casing may have the same unique code as the projectiles. This can allow the casing to be matched to the projectile. In this instance, the casing may be trackable back to an owner. For example, a casing found at a crime scene may be traceable to a manufacturer. The manufacturer may then be able to tell law enforcement who the ammunition was sold to and law enforcement may then review sales receipts or in-store video in an attempt to identify who purchased the ammunition.

Figure 3:
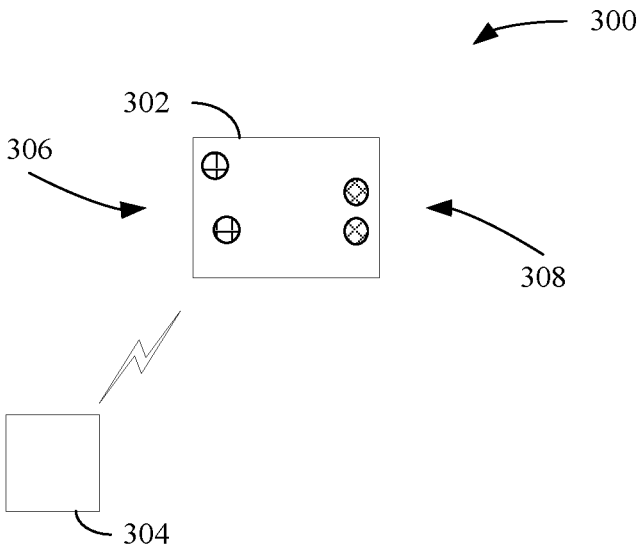
FIG. 3 shows a system for tracking ammunition constant with embodiments disclosed herein.
Figure 4:
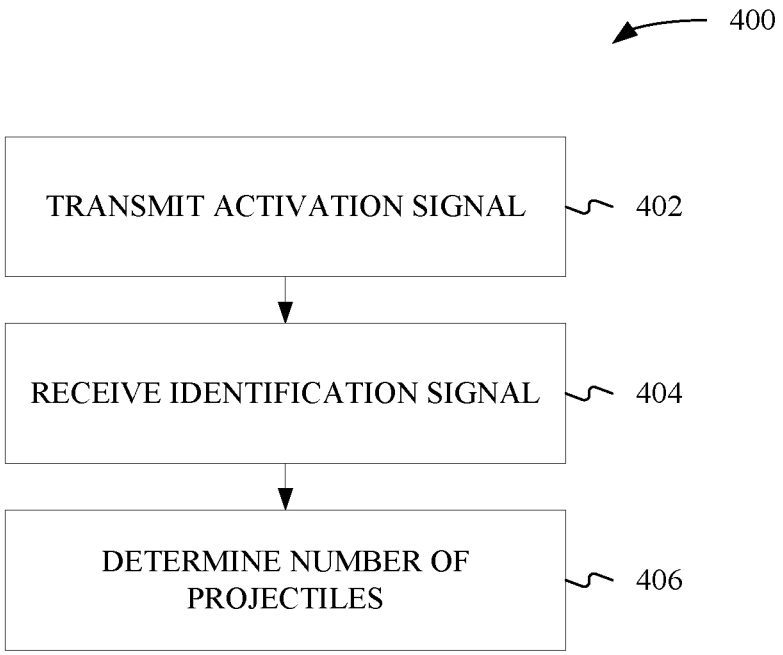
FIG. 4 shows a method for tracking ammunition constant with embodiments disclosed herein.

FIG. 3 shows and example system 300 for tracking ammunition in accordance with embodiments disclosed herein. FIG. 4 shows an example method 400 for tracking ammunition in accordance with embodiments disclosed herein. System 300 may include a target 302 and a scanner 304. As shown in FIG. 3, first projectiles 306 and second projectiles 308 may be embedded within target 302. First projectiles 306 and second projectiles 308 may be any projectiles, such as projectiles 112 and projectile 208.

First projectiles 306 and second projectiles 308 may be shot from shotgun shells. For example, during a hunt, two different hunters may shoot game (i.e., target 302), such as a bird. The hunters may not know which of the two actually had the best aim and therefore caused more of his or her shot to strike the game. However, because first projectiles 306 and second projectiles 308 are embedded within target 302, scanner 304 may be used to identify first projectiles 306 and second projectiles 308.

As disclosed herein, scanner 304 may transmit an activation signal (stage 402). The activation signal may excite RFID chips embedded within first projectiles 306 and second projectiles 308. Still consistent with embodiments disclosed herein, the activation signal may include x-rays, ultraviolent or infrared light, a magnetic field, etc.

Scanner 304 may also receive an identification signal (stage 404). The identification signal may include a response, including a code or other signature, from RFID chips embedded within first projectiles 306 and second projectiles 308. In other embodiments, the identification signal may include a color of reflected light, a measurement of a magnetic field, etc. as disclosed herein. Scanner 304 may determine the signature (e.g., code from the RFID chip, the color of emitted light, magnetic disturbance, etc.) within the identification signal.

Once the identification signals are received, scanner 304 may determine a number of first projectiles 306 and a number of second projectiles 308 embedded within target 302 (stage 406). To determine the number of projectiles within target 302, scanner 304 may use the code emitted from the RFID chips or other indicators. For example, as scanner 304 is passed near target 302, scanner 304 may detect each of the RFID chips, which emit a code. Scanner 304 can count the number of codes received and because scanner 304 includes data that allows scanner 304 to associate the codes to first projectiles 306 and second projectiles 308.

Scanner 304 may include an optical sensor that is able to distinguish various light spectrums within the ultraviolent, visible, and infrared spectrums. Thus, when the projectiles include a chemical that emits light in response to the activation signal, scanner 304 may detect the light. Based on intensity of the light, scanner 304 may count the projectiles. For example, two projectiles spaced apart from one another may emit light based on the chemical impregnated within the projectiles and in between the projectiles the intensity of the light will be different. Thus, scanner 304 may use the difference in light patterns to count the projectiles.

Scanner 304 may include a EMF meter or Gauss meter that is used to measure magnetic fields or disturbances in a magnetic field. When scanner 304 is located near target 302, scanner 304 may measure different magnetic fields or different disturbances in magnetic fields proximate each of first projectiles 306 and second projectiles 308. Scanner 304 may use the measurements to count the projectiles because scanner 304 may include data that associates the measurements with first projectiles 306 and second projectiles 308.

Figure 5:
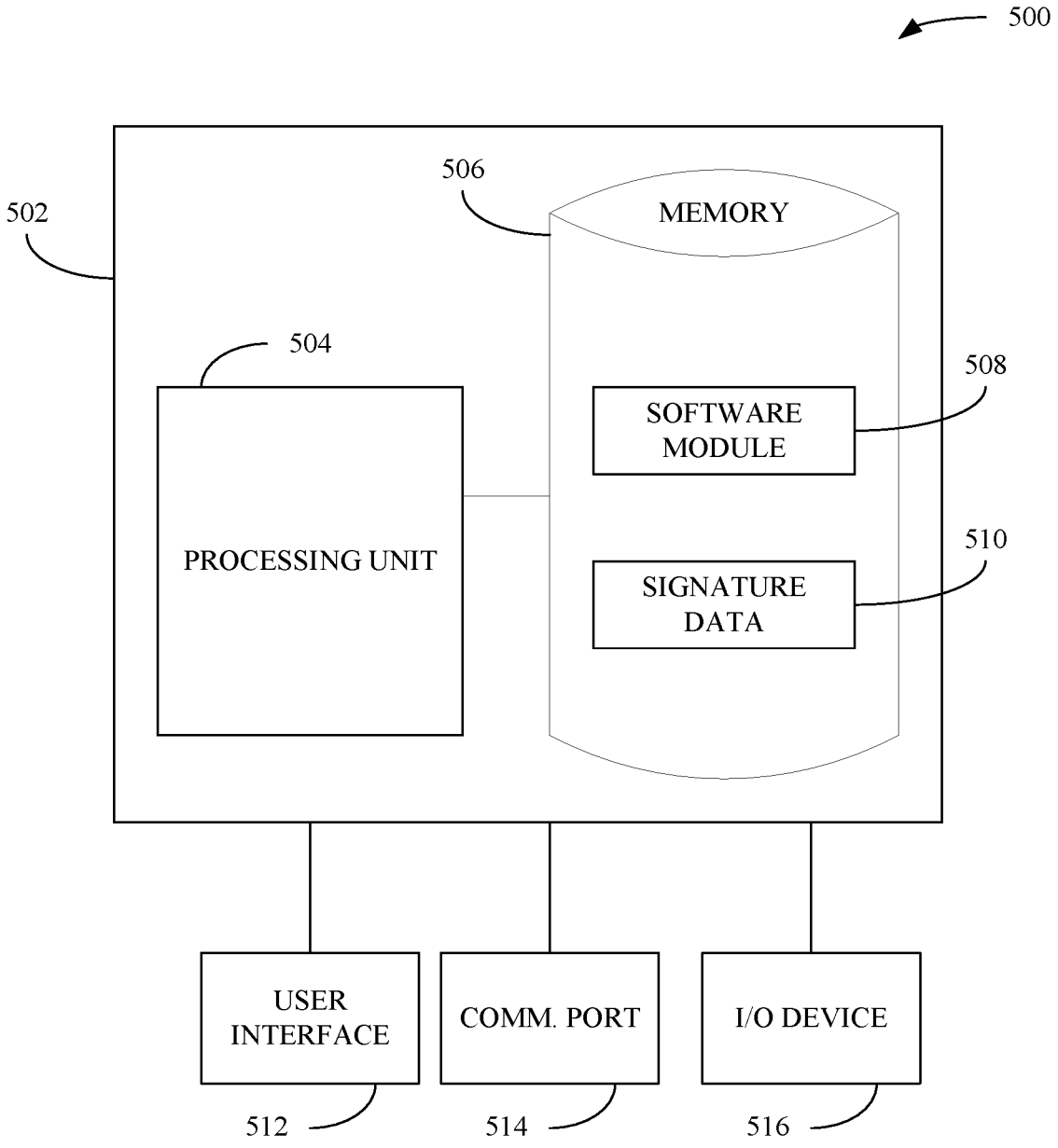
FIG. 5 shows an example schematic of a scanner consistent with embodiments disclosed herein.

FIG. 5 shows an example schematic of a scanner 500, such as scanner 304, consistent with embodiments disclosed herein. As shown in FIG. 5, scanner 500 may include a controller 502, which may include a processor 504 and a memory 506. Memory 506 may include a software module 508 and signature data 510. While executing on processor 504, software module 506 may perform processes for tracking ammunition, including, for example, one or more stages included in method 400 described above with respect to FIGS. 3 and 4. Scanner 500 also may include a user interface 512, a communications port 514, and an input/output (I/O) device 516.

As disclosed herein, software module 508 may include instructions that when executed by processor 504, cause scanner 500 to transmit activation signals, receive identification signals, and determine a number of projectiles embedded within a target.

Signature data 510 may include the signatures for the projectiles. For example, at the beginning of a hunt each hunter may be given ammunition by a guide. The ammunition for each hunter may have a unique marker that includes a unique signature. For example, each of the projectiles of the ammunition may include a RFID chip as disclosed herein. The code emitted by the various RFID chips may be stored as signature data 510. To load the signatures on scanner 500, a user may scan a barcode on a box that the ammunition is sold or stored in. The barcode may include the signature or information about the signature, such as information related to color or magnetic field, as disclosed herein.

User interface 512 can include any number of devices that allow a user to interface with scanner 500. Non-limiting examples of user interface 512 include a keypad, a microphone, a display (touchscreen or otherwise), etc.

Communications port 514 may allow scanner 500 to communicate with various information sources and devices, such as, but not limited to, remote computing devices such as servers or other remote computers maintained by hunting guides, law enforcement, mobile devices such as a user's smart phone, peripheral devices, etc. Non-limiting examples of communications port 514 include, Ethernet cards (wireless or wired), Bluetooth® transmitters and receivers, near-field communications modules, etc.

I/O device 516 may allow scanner 500 to receive and output information. Non-limiting examples of I/O device 516 include, a camera (still or video), RFID transceivers, EMF metes, Gauss meters, etc.

Scanner 500 may be a user's smartphone or a dedicated computing device such as a portable computing device. For example, scanner 500 may be a user's smartphone or a RFID that is operatively connected (e.g., plugged into or connect wirelessly via a BLUETOOTH® or WIFI® connection) to the user's smartphone. Scanner 500 may be fixed or stationary. For example, scanner 500 may be an x-ray machine. Scanner 500 may be a component used by the military or law enforcement. For example, a projectile and the marker may be component of ordnance, such as a bomb or a missile. The scanner may be a component of aircraft, such as a plane or helicopter. After a missile or bomb is used, the aircraft may overfly the area and, using scanner 500, may scan the area detect components of the detonated ordnance.

EXAMPLES

Example 1 is ammunition comprising: a first projectile; and a marker associated with the first projectile, the marker containing a unique signature such that the first projectile is identifiable from a second projectile.

In Example 2, the subject matter of Example 1 optionally includes wherein the first projectile defines a cavity and the marker is located with the cavity.

In Example 3, the subject matter of any one or more of Examples 1-2 optionally include wherein the marker includes a radio frequency identifier tag.

In Example 4, the subject matter of any one or more of Examples 1-3 optionally include wherein the marker includes a chemical marker.

In Example 5, the subject matter of any one or more of Examples 1~4 optionally include wherein the marker includes the first projectile having a metallurgical composition that is different than a metallurgical composition of the second projectile.

In Example 6, the subject matter of any one or more of Examples 1-5 optionally include wherein the marker does not require one or more striations created by firing the ammunition.

In Example 7, the subject matter of any one or more of Examples 1-6 optionally include wherein the first projectile is shot and the ammunition is a shotgun round.

In Example 8, the subject matter of any one or more of Examples 1-7 optionally include wherein the first projectile is a bullet and the ammunition is a rifle or pistol round.

In Example 9, the subject matter of any one or more of Examples 1-8 optionally include wherein the first projectile and the marker are components of a missile or a bomb.

Example 10 is shotgun ammunition comprising: a first plurality of projectiles; and a plurality of markers, each of the plurality of markers associated with a corresponding one of the first plurality of projectiles and containing a unique signature such that the first plurality of projectiles is identifiable from a second plurality of projectiles.

In Example 11, the subject matter of Example 10 optionally includes wherein each of the first plurality of projectiles defines a cavity and the marker associated with the corresponding one of the first plurality of projectiles is located within the cavity.

In Example 12, the subject matter of any one or more of Examples 10-11 optionally include wherein the plurality of markers includes a radio frequency identifier tag associated with each of the first plurality of projectiles.

In Example 13, the subject matter of any one or more of Examples 10-12 optionally include wherein the plurality of markers includes a chemical marker.

In Example 14, the subject matter of any one or more of Examples 10-13 optionally include wherein the plurality of markers includes the first plurality of projectiles having a different metallurgical composition then the second plurality of projectiles.

In Example 15, the subject matter of any one or more of Examples 10-14 optionally include wherein the marker does not require one or more striations created by firing the ammunition.

Example 16 is an ammunition tracking system comprising: a first ammunition comprising: a first projectile, and a first marker associated with the first projectile, the first marker containing a first signature; and a second ammunition comprising: a second projectile; and a second marker associated with the second projectile, the second marker containing a second signature, wherein the first signature and the second signature are different.

In Example 17, the subject matter of Example 16 optionally includes a portable computing device having a controller operable to cause the portable computing device to perform actions comprising reading the first signature and the second signature.

In Example 18, the subject matter of any one or more of Examples 16-17 optionally include wherein the first projectile is one of a plurality of first projectiles having the first signature and the second projectile is one of a second plurality of projectiles having the second signature.

In Example 19, the subject matter of Example 18 optionally includes a portable computing device having a controller operable to cause the portable computing device to perform actions comprising: reading the first signature and the second signature; determining a number of the first plurality of projectiles embedded within a target; and determining a number of the second plurality of projectiles embedded with the target.

In Example 20, the subject matter of Example 19 optionally includes wherein determining the number of the first plurality of projectiles and determining the number of the second plurality of projectiles includes the controller operable to cause the portable computing device to perform further actions comprising: reading first RFID tags associated with the number of the first plurality of projectiles; and reading second RFID tags associated with the number of the second plurality of projectiles.

Example 21 is an ammunition tracking system for tracking ammunition comprising a first plurality of projectiles, each of the first plurality of projectiles having a first marker having a first signature and a second plurality of projectiles, each of the second plurality of projectiles having a second marker having a second signature, the ammunition tracking system comprising: a transceiver; a processor; and a memory storing instructions that, when executed by the processor, cause the ammunition tracking system to: transmit, via the transceiver, an activation signal, receive, at the transceiver, an identification signal, the identification signal including the first signature from each of the first plurality of projectiles embedded within a target and the second signature from each of the second plurality of projectiles embedded within the target, and determine a number of the first plurality of projectiles embedded within the target and a number of the second plurality of projectiles embedded within the target using the identification signal.

In Example 22, the subject matter of Example 21 optionally includes wherein each of the first plurality of projectiles defines a first cavity and the first marker is located with the first cavity.

In Example 23, the subject matter of any one or more of Examples 21-22 optionally include wherein each of the second plurality of projectiles defines a second cavity and the second marker is located with the second cavity.

In Example 24, the subject matter of any one or more of Examples 21-23 optionally include wherein the first marker or the second marker includes a radio frequency identifier tag.

In Example 25, the subject matter of any one or more of Examples 21-24 optionally include wherein the first marker and the second marker includes a radio frequency identifier tag.

In Example 26, the subject matter of any one or more of Examples 21-25 optionally include wherein the first marker includes a chemical marker.

In Example 27, the subject matter of any one or more of Examples 21-26 optionally include wherein the first marker and the second marker each includes the first plurality of projectiles having a metallurgical composition that is different than a metallurgical composition of the second plurality of projectiles.

In Example 28, the subject matter of any one or more of Examples 21-27 optionally include wherein the first marker and second marker each does not require one or more striations created by firing the ammunition.

In Example 29, the subject matter of any one or more of Examples 21-28 optionally include wherein the first plurality of projectiles or the second plurality of projectiles are components of a shotgun round.

In Example 30, the subject matter of any one or more of Examples 21-29 optionally include wherein the first plurality of projectiles and the second plurality of projectiles are components of shotgun rounds.

In Example 31, the subject matter of any one or more of Examples 21-30 optionally include wherein the portable computing device includes a smartphone or a RFID reader operatively connected to the smartphone.

In Example 32, the ammunition and systems of any one of or any combination of Examples 1-31 is optionally configured such that all elements or options recited are available to select from or use.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

The invention claimed is:

1. An ammunition tracking system comprising:
- a first ammunition comprising:
  - a first projectile, and
  - a first marker associated with the first projectile, the first marker containing a first signature;
  - wherein the first projectile is one of a plurality of first projectiles having the first signature; and
- a second ammunition comprising:
  - a second projectile; and
  - a second marker associated with the second projectile, the second marker containing a second signature, wherein the first signature and the second signature are different;
  - wherein the second projectile is one of a second plurality of projectiles having the second signature.

2. The tracking system of claim 1, further comprising a portable computing device having a controller operable to cause the portable computing device to perform actions comprising reading the first signature and the second signature.

3. The tracking system of claim 1, further comprising a portable computing device having a controller operable to cause the portable computing device to perform actions comprising:
- reading the first signature and the second signature;
- determining a number of the first plurality of projectiles embedded within a target; and
- determining a number of the second plurality of projectiles embedded with the target.

4. The tracking system of claim 3, wherein determining the number of the first plurality of projectiles and determining the number of the second plurality of projectiles includes the controller operable to cause the portable computing device to perform further actions comprising:

reading first RFID tags associated with the number of the first plurality of projectiles; and reading second RFID tags associated with the number of the second plurality of projectiles.

5. An ammunition tracking system for tracking ammunition comprising a first plurality of projectiles, each of the first plurality of projectiles having a first marker having a first signature and a second plurality of projectiles, each of the second plurality of projectiles having a second marker having a second signature, the ammunition tracking system comprising:

a transceiver;

a processor; and a memory storing instructions that, when executed by the processor, cause the ammunition tracking system to:

transmit, via the transceiver, an activation signal, receive, at the transceiver, an identification signal, the identification signal including the first signature from each of the first plurality of projectiles embedded within a target and the second signature from each of the second plurality of projectiles embedded within the target, and determine a number of the first plurality of projectiles embedded within the target and a number of the second plurality of projectiles embedded within the target using the identification signal.

6. The ammunition tracking system of claim 5, wherein each of the first plurality of projectiles defines a first cavity and the first marker is located with the first cavity.

7. The ammunition tracking system of claim 5, wherein each of the second plurality of projectiles defines a second cavity and the second marker is located with the second cavity.

8. The ammunition tracking system of claim 5, wherein the first marker or the second marker includes a radio frequency identifier tag.

9. The ammunition tracking system of claim 5, wherein the first marker and the second marker includes a radio frequency identifier tag.

10. The ammunition tracking system of claim 5, wherein the first marker includes a chemical marker.

11. The ammunition tracking system of claim 5, wherein the first marker and the second marker each includes the first plurality of projectiles having a metallurgical composition that is different than a metallurgical composition of the second plurality of projectiles.

12. The ammunition tracking system of claim 5, wherein the first marker and second marker each does not require one or more striations created by firing the ammunition.

13. The ammunition tracking system of claim 5, wherein the first plurality of projectiles or the second plurality of projectiles are components of a shotgun round.

14. The ammunition tracking system of claim 5, wherein the first plurality of projectiles and the second plurality of projectiles are components of shotgun rounds.

15. The ammunition tracking system of claim 5, wherein the ammunition tracking system is portable computing device that includes at least one of a smartphone or an RFID reader operatively connected to the smartphone.

* * * * *